US006539678B1

(12) United States Patent
Campbell et al.

(10) Patent No.: US 6,539,678 B1
(45) Date of Patent: Apr. 1, 2003

(54) VEHICLE SERVICE BAY

(76) Inventors: Robert E. Campbell, 3627 Hubbard-West Middlesex Rd., West Middlesex, PA (US) 16159; T. Scott Campbell, 49 Terri Dr., West Middlesex, PA (US) 16159

( * ) Notice: Subject to any disclaimer, the term of this patent is extended or adjusted under 35 U.S.C. 154(b) by 0 days.

(21) Appl. No.: 09/906,020

(22) Filed: Jul. 16, 2001

(51) Int. Cl.[7] ..... B65D 90/18

(52) U.S. Cl. ..... 52/169.7; 52/169.1; 52/174; 52/236.3; 49/27; 49/33; 49/125; 49/127; 49/463; 49/466; 160/133; 160/193; 160/287; 220/18; 220/245

(58) Field of Search ..... 52/169.1, 169.6, 52/30, 31, 236.3, 169.7, 174; 49/33, 463–466, 489.1, 125, 127, 27; 198/323–325; 160/133, 201, 193, 218, 236, 287; 220/18, 345, 346; 182/130–132

(56) References Cited

U.S. PATENT DOCUMENTS 3,007,212 A * 11/1961 Gazin
3,866,624 A 2/1975 Peterson
4,188,985 A * 2/1980 Osterman ..... 141/98
4,284,173 A * 8/1981 Patterson ..... 184/1.5
4,341,253 A * 7/1982 Eyerle ..... 160/133
4,628,646 A * 12/1986 Eyerle ..... 52/169.7
4,762,242 A * 8/1988 Harris et al. ..... 220/18
4,789,047 A * 12/1988 Knobloch ..... 184/1.5
4,805,360 A * 2/1989 Kuehnl ..... 52/169.1
4,960,150 A 10/1990 Ryan
5,189,836 A * 3/1993 Alder et al. ..... 49/33
5,701,706 A 12/1997 Kreysler et al.
5,738,160 A 4/1998 Rice
6,088,963 A * 7/2000 Cawthon et al. ..... 49/33
6,142,286 A * 11/2000 Ulrich et al. ..... 198/325
6,189,272 B1 * 2/2001 Deiss et al. ..... 52/236.3

* cited by examiner

*Primary Examiner*—Carl D. Friedman
*Assistant Examiner*—Yvonne M Horton
(74) *Attorney, Agent, or Firm*—Harpman & Harpman

(57) ABSTRACT

A pre-fabricated service bay used for providing service access to the underside of vehicles. The service bay is fabricated as a single monolithic unit and then positioned in an excavated hole within a service building. The service bay has multiple safety cover grids that are hydraulically activated to enclose the bay's opening when not in use. An access stairway is retractable within the bay during use with a deployable safety handrail that collapses upon stairway retraction.

10 Claims, 6 Drawing Sheets

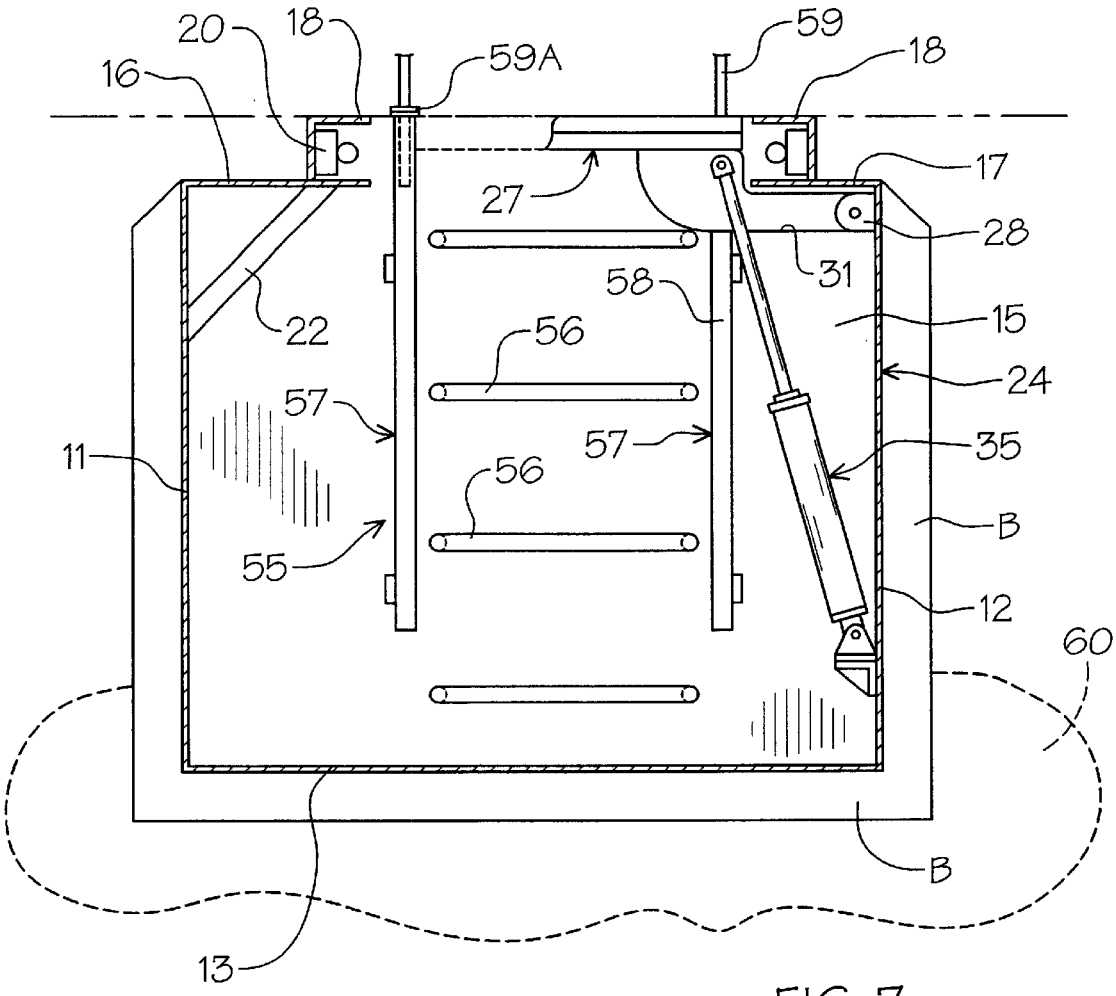
FIG. 7
FIG. 8
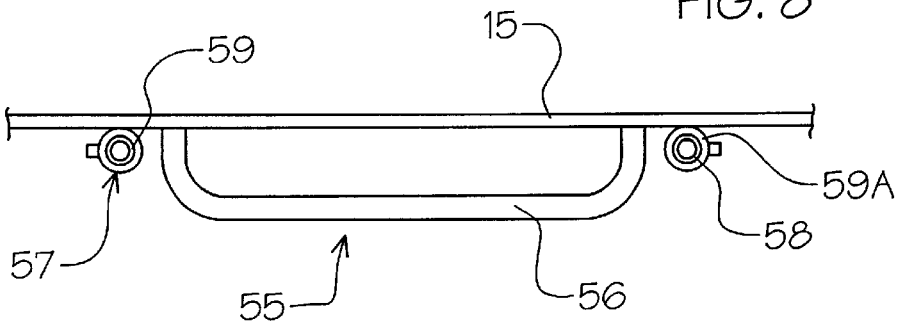

VEHICLE SERVICE BAY

BACKGROUND OF THE INVENTION

1. Technical Field

This device relates to the servicing of vehicles that require access to the underside and specifically to large vehicles such as trucks and the like.

2. Description of Prior Art

Prior art devices of this type are typically defined as excavated pits that are built in place which are used for vehicle servicing to eliminate the need to lift a vehicle in the air to gain access to the underside serviceable components. Such service pits are located in garage service areas and are typically custom built in place for strength and durability and ease of construction. Access to such service pits are by ladder or underground access tunnels with remote stairs as typically found in vehicle oil changing facilities. Service pits of this type are particularly useful and required in the service of large heavy vehicles such as trucks where it is often impossible to elevate the vehicle for service.

Examples of in ground service pits can be seen in U.S. Pat. Nos. 3,866,624, 4,960,150, 5,701,706, and 5,738,160.

In U.S. Pat. No. 3,866,624 an automobile service lane with servicing pit can be seen wherein a pit is provided adjacent gasoline pumps. A retractable pit shield is disclosed disposed within a recess portion along one side of the pit.

In U.S. Pat. No. 4,960,150 a movable safety cover for vehicle service pits is shown in which a cover configuration is positioned over the service pit in multiple retractable overlapping sections which have wheel assemblies on their adjacent corners.

In U.S. Pat. No. 5,701,706 an underground service bay for vehicles and process for constructing same is disclosed. The service bay is formed of a tunnel like structure of molded fiberglass that is buried in the ground with a concrete cap to provide vehicle support.

Finally, in U.S. Pat. No. 5,738,160 a removable cover for automobile service pit and method of installation is claimed in which a safety cover made up of a webbing material is deployable between tracks positioned on either side of the longitudinal edge openings of the service pit.

Applicant's device illustrates a pre-fabricated base structure that has a plurality of rigid cover grates that are deployable from inside the bay. A retractable folding stairway allows for select access upon activation to the bay.

SUMMARY OF THE INVENTION

A self-contained pre-fabricated in ground service bay for providing an access opening to the underside of vehicles to be serviced. The service bay has deployable safety closure grates and a movable stairway access assembly that can be retracted within the bay during use.

DESCRIPTION OF THE DRAWINGS

FIG. 7 is an end elevational view of a fixed access ladder assembly within the bay; and FIG. 8 is a partial top plan view of the fixed ladder assembly shown in FIG. 7.

DESCRIPTION OF THE PREFERRED EMBODIMENT

Figure 1:
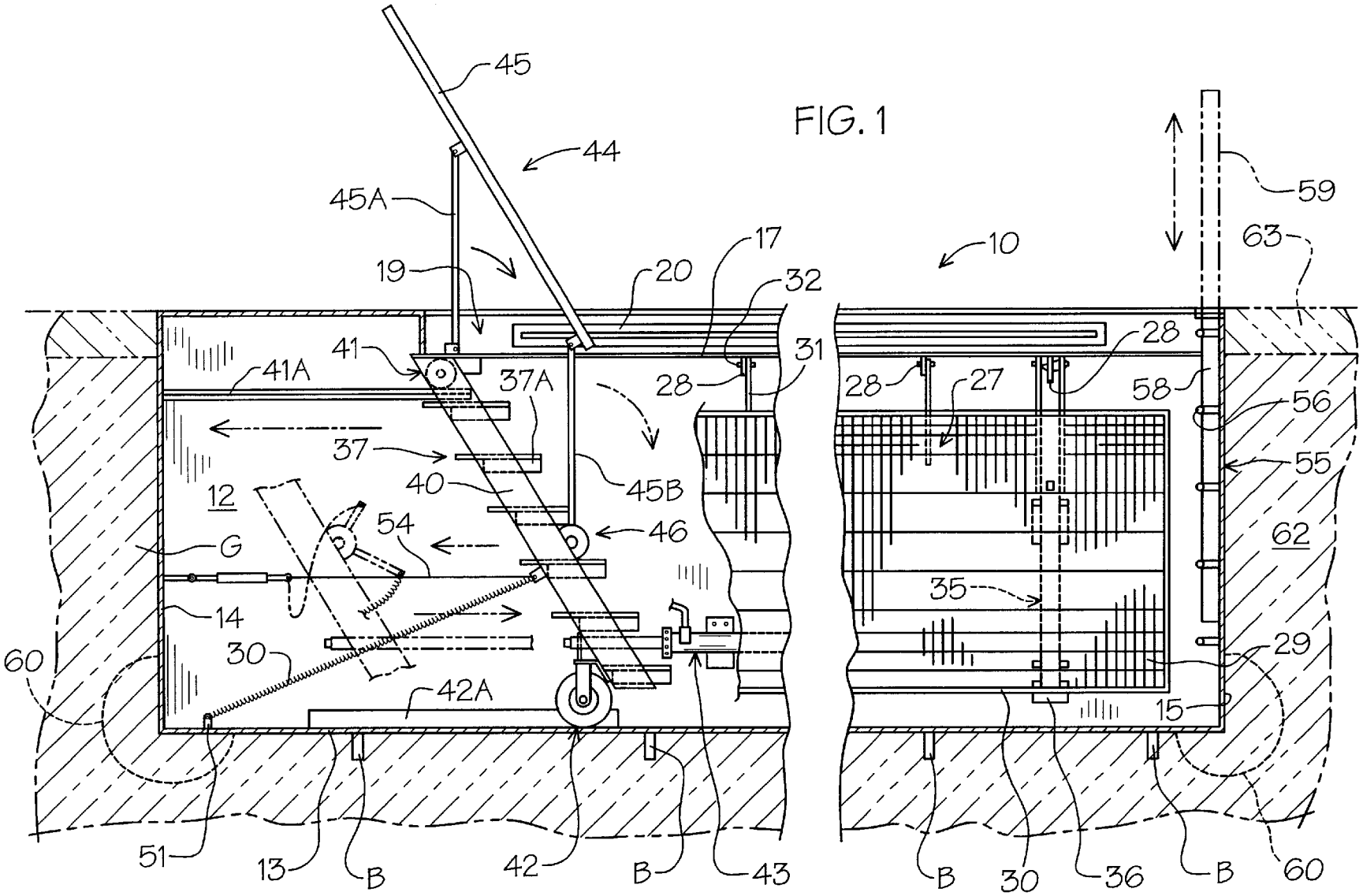
FIG. 1 is a side elevational section with portions broken away of the service bay of the invention.
Figure 2:
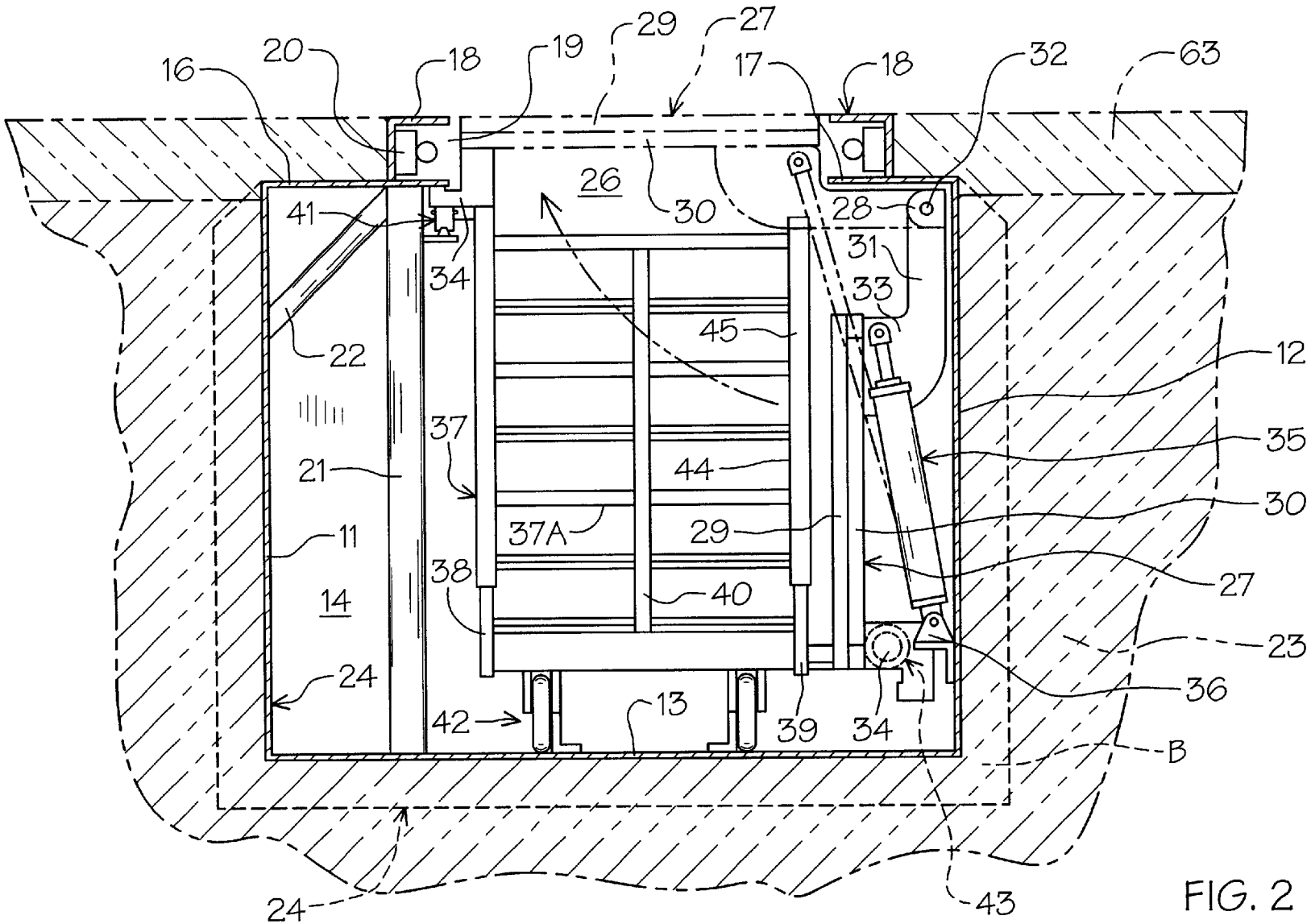
FIG. 2 is an end elevation section illustrating the access stairway assembly.

Referring now to FIGS. 1 and 2 of the drawings, an underground service bay 10 of the invention can be seen installed within the ground G. The service bay 10 is of a generally elongated rectangular configuration having oppositely disposed sidewalls 11 and 12 with a floor 13 extending therebetween and respective end walls 14 and 15 as best seen in FIG. 1 of the drawings. A pair of oppositely disposed elongated flanges 16 and 17 extend at right angles from along the respective top perimeter edges of the sidewalls 11 and 12. Elongated lighting retention brackets 18 extend vertically from the flanges 16 and 17 in spaced relation to said respective sidewalls 11 and 12 forming lighting channels at 19 inwardly and along the top of the respective sidewalls 11 and 12. Lighting fixtures 20 are positioned within the lighting channels 19 as will be well understood by those skilled within the art.

A number of longitudinally spaced flange support posts 21 extend vertically from the floor 13 to the flange 16 with a plurality of intermediately positioned angle support brackets 22 extend between the sidewall 11 and the top flange 16 as will best be seen in FIG. 2 of the drawings.

A plurality of longitudinally spaced exterior stabilization braces B extend around the exterior surfaces 24 of the walls 11 and 12 exterior surface of the floor 13 to stiffen and support same.

It will be evident from the above description that the service bay 10 will have an elongated rectangular service opening at 26 between the respective flanges 16 and 17 for access to the undersides of a vehicle (not shown). Accordingly, a series of safety panels 27 are pivotally secured to the sidewalls 12 by multiple apertured brackets 28. Each of the panels 27 is formed from surface grating 29 on a frame 30 as best seen in FIGS. 1 and 2 of the drawings. Support arms 31 extend from the panels 27 to the apertured brackets 28 and are pivotally secured by pivot pins 32. The support arms 31 are longitudinally offset at 33 so as to position the respective surface grating 29 flush within the opening at 26. Alignment stop brackets 34 extend from the respective panels to engage the flange 16 restricting the panels 27 for the flush alignment hereinbefore described. Each of the panels 27 have multiple hydraulic piston and cylinder actuation assemblies 35 pivotally secured to wall mounting brackets 36 and pairs of activation arms 31 pivoted to the respective apertured brackets 28.

Figure 3:
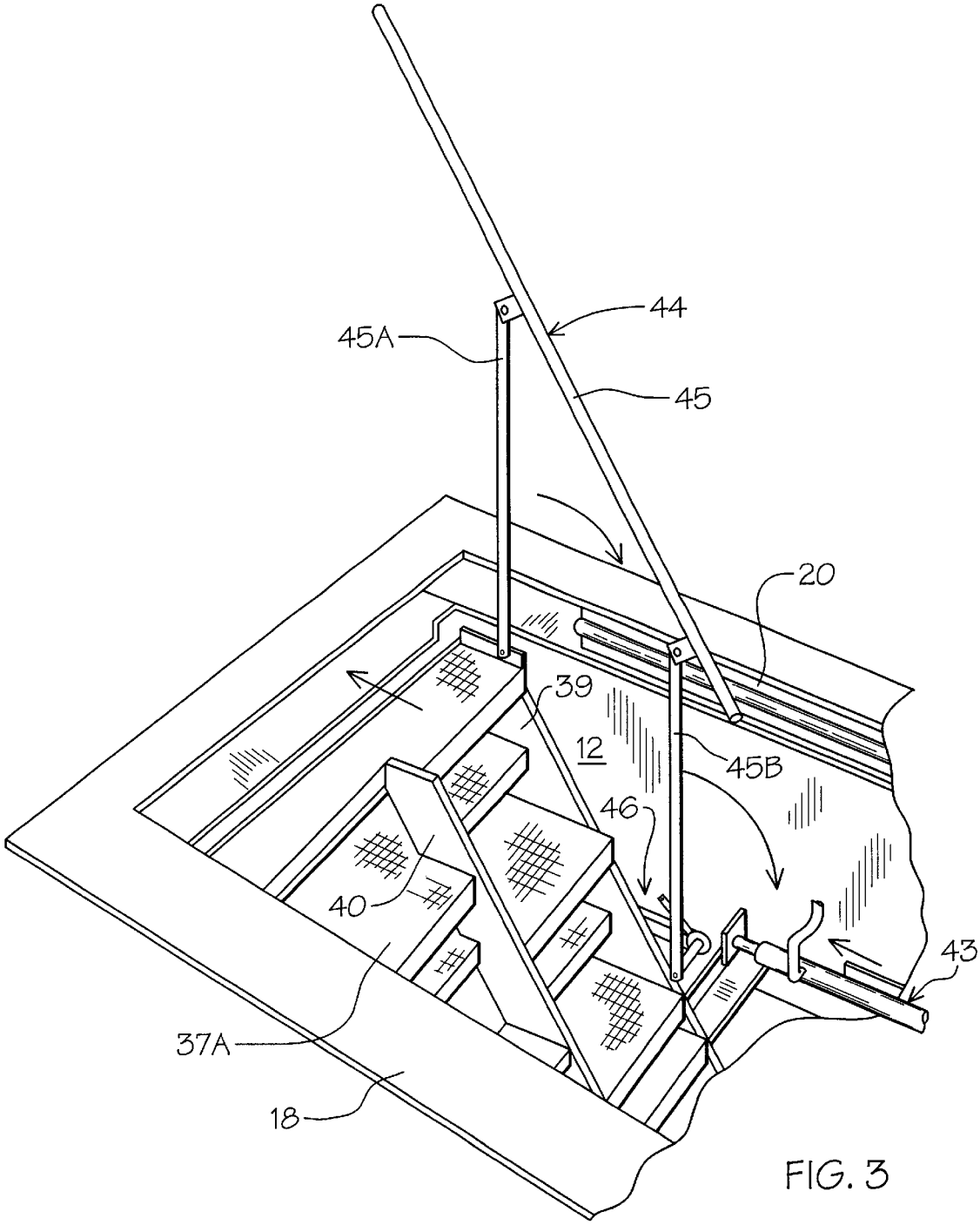
FIG. 3 is a perspective view of a portion of the service bay with the access stairway deployed.
Figure 4:
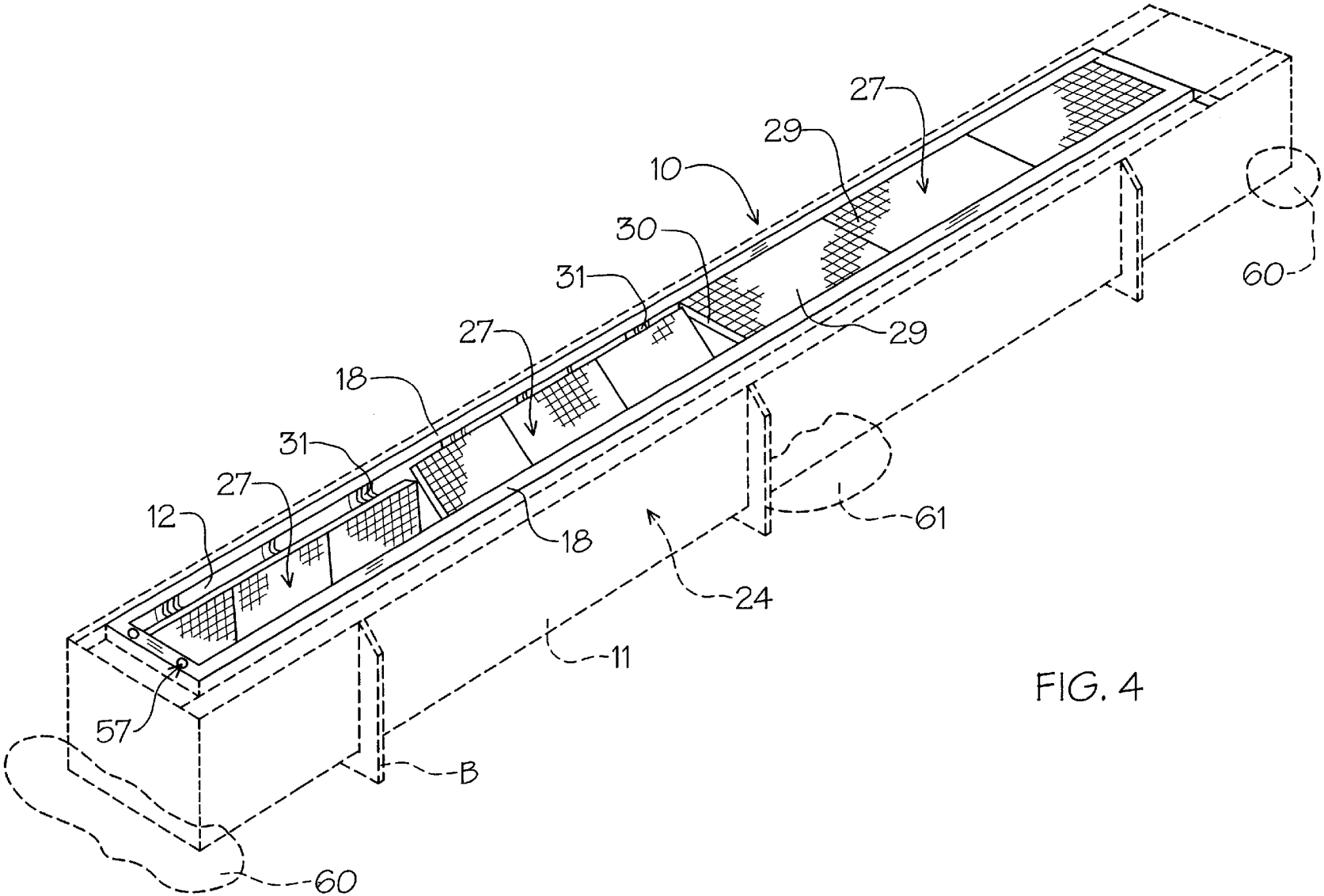
FIG. 4 is a perspective view of an installed service bay.

A retractable stairway assembly 37 can be seen in FIGS. 1 and 2 of the drawings having multiple stair treads 37A each of which is of an alternating tread depth extending between outer stair stringers 38 and 39 and defined therebetween by a center support stringer 40 as illustrated in FIG. 3 of the drawings. This alternating depth tread arrangement provides for a shortened stairway of increased angular ascension. The stairway 37 is supported on respective pairs of wheel assemblies 41 and 42 engageable in upper and lower guide support tracks 41A and 42A respectively inside the bay.

A hydraulic piston and cylinder assembly 43 secured to the sidewall 12 and lower wheel assembly 42 moves the stairway assembly 37 within the service bay from an access position indicated in solid lines to a non-use stored position as shown in broken lines. A collapsible stair handrail assembly 44 has a pair of spindles 45A and 45B pivotally secured to the stringer 39 and to a rail 45.

Figure 5:
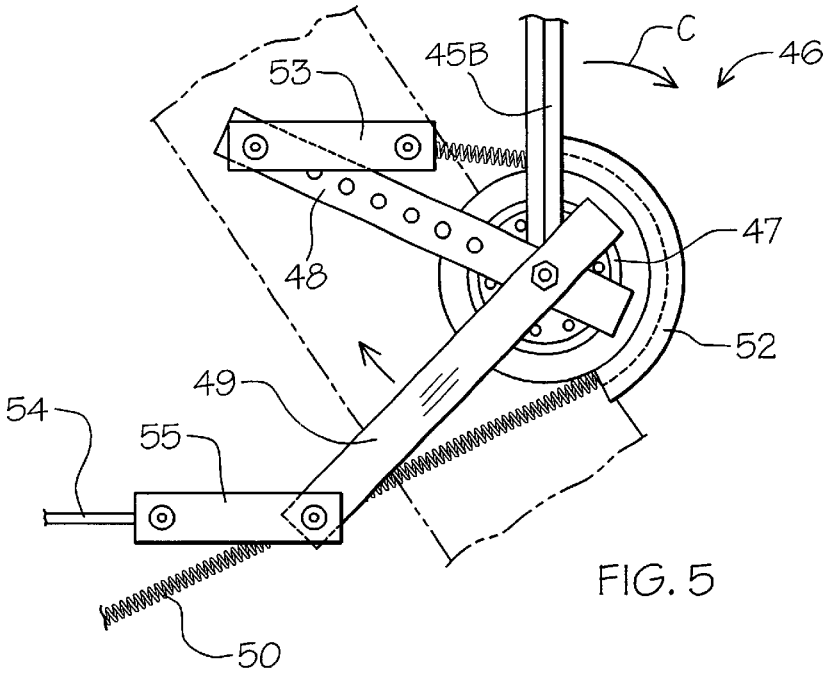
FIG. 5 is an enlarged side elevational view of the stairway railing retraction and activation assembly in deployed position.
Figure 6:
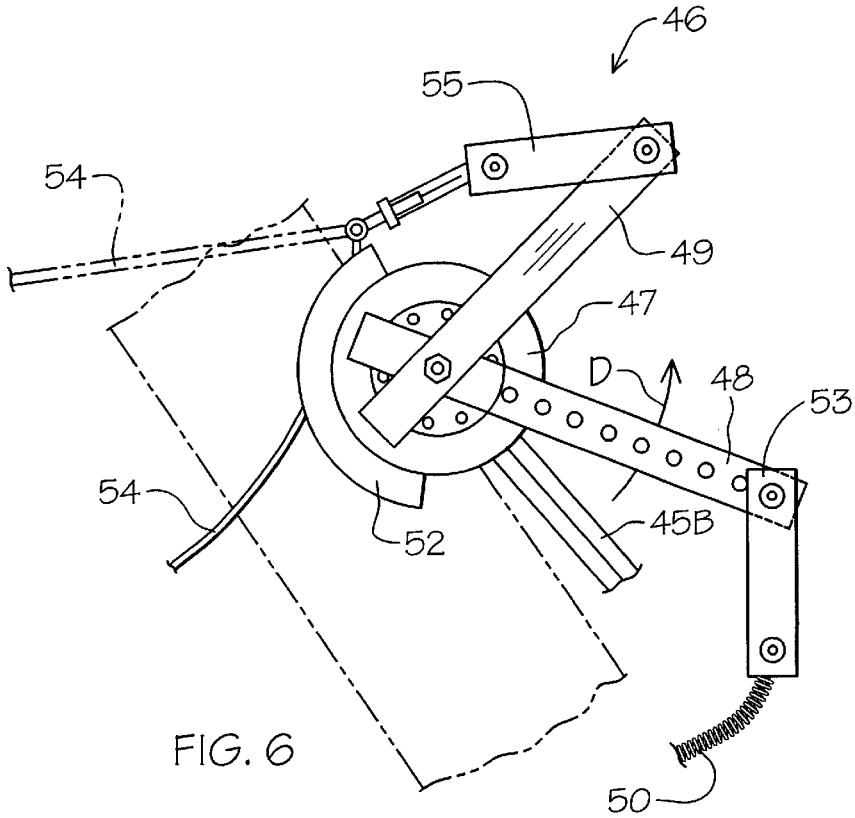
FIG. 6 is an enlarged side elevational view of the stairway railing ratchet and activation assembly in closed position.

Referring now to FIGS. 5 and 6 of the drawings, a tensioning and release mechanism 46 inner engages the stair spindle 45B having a central hub 47 with a pair of annularly offset engagement arms 48 and 49 extending therefrom. An elongated coil spring 50 extends from a bracket 51 on the bay floor 13 around the hub 47 within a spring guard 52 to a link 53 that pivotally extends from the end of the hereinbefore-described engagement arm 48.

A deployment cable 54 is adjustably secured to the end wall 14 of the service bay 10 and to a link 55 pivoted to the engagement arm 49. With the stair assembly in open access position, the spring 50 is expanded applying tension to the engagement arm 48 and against the deployment cable 54. As the piston and cylinder assembly 43 pushes the stairway back to its stored position, shown in broken lines, tension on the cable 54 releases and the spring 50 rotates the hub 47 via the engagement arm 48 pivoting the stair spindle 45B in a clockwise direction as viewed in FIG. 5 illustrated by directional arrow C.

The rail 45 and spindles 45A and 45B pivot downwardly retracting the handrail assembly 44 to a closed position as illustrated in FIG. 6 of the drawings.

Referring now to FIGS. 1, 2, 3 and 6 of the drawings, to open the stairway assembly 37 and deploy the handrail assembly 44, it will seen that as the piston and cylinder 43 pulls the stairway 37 forward on its respective wheel assemblies 41 and 42 that the cable 54 goes into tension, illustrated in broken lines in FIG. 6, rotating the hub 47 and attached spindle 45B as indicated by arrow D, unfolding the handrail assembly 44 to an upright access position as seen in FIG. 3 of the drawings against the tension of the spring 50.

Referring now to FIGS. 7 and 8 of the drawings, the end wall is of the service bay 10 can be seen having an auxiliary fixed ladder assembly 55 secured thereon. The ladder assembly 55 has a plurality of fixed generally U-shaped rungs 56 that are horizontally disposed at vertically spaced intervals and extend outwardly from the wall surface 15. A pair of safety handrail assemblies 57 are positioned in oppositely disposed relation alongside the rungs 56. Each of the rail assemblies 57 has a guide tube 58 with telescopically extensible handrails 59 within.

In use, the respective handrails 59 are raised manually so as to extend from the service bay 10 and secured by a locking assemblies 59A to aid the user in climbing down or up out of the service bay 10.

During installation of the service bay 10 of the invention, it will be noted that it is positioned within an excavated opening in the ground G, it will initially be stabilized by pouring concrete around its respective end areas 60 and middle area 61. Once stabilized, back fill 62 is used to bury the service bay 10 as will be well understood by those skilled in the art.

A finished floor 63 which in this example is poured concrete will overlie the respective flanges 16 and 17 and be flush with an upper surface 64 of the lighting channels 19 as illustrated in FIG. 1 of the drawings.

It will thus be seen from the above detailed description that a new and useful modular self-contained service bay pit enclosure has been illustrated and described that provides a unique service access to the underside of large vehicles. It will also be apparent to those skilled in the art that various changes and modifications may be made thereto without departing from the spirit of the invention.

Therefore I claim:

1. An underground service bay comprising, a pre-fabricated construction having oppositely disposed sides and end walls, and an integral bottom interconnected therewith, return flanges extending inwardly from said respective walls defining a finished grade and access opening there between, a plurality of hinged panels in said service bay registerable within said access opening pivotally secured within and to said service bay, a movable access stairway within said service bay, said stairway having a retraction and deployment mechanism, a collapsible handrail pivotally secured to said stairway with multiple stair treads on wheeled assemblies, and means for positioning the pre-fabricated construction of the invention in the ground.

2. The underground service bay set forth in claim 1 further comprises, an egress ladder within said service bay said egress ladder comprises multiple vertically spaced horizontal ladder rungs extending in spaced relation from said end wall opposite said stairway, telescopically extensible ladder rails adjacent said ladder rungs.

3. The underground service bay set forth in claim 1 wherein said stairway deployment and retraction mechanism comprises, a piston and cylinder assembly, a hand rail hub engagement assembly having a rail deployment cable and a resilient hand rail retraction element.

4. The underground service bay set forth in claim 1 wherein said return flanges define oppositely disposed light channels facing said access opening below said finished grade.

5. The underground service bay set forth in claim 1 wherein said stair treads are divided into tread portions of correspondingly alternating unequal tread depths.

6. An underground service bay comprising, a pre-fabricated construction having oppositely disposed sides and end walls, and an integral bottom interconnected therewith, return flanges extending inwardly from said respective walls defining a finished grade and access opening there between, a plurality of hinged panels in said service bay registerable within said access opening, each of said hinged panels having a support frame, service grading on said frame and support arms extending from said frame pivotally secured within said service bay, a movable access stairway within said service bay, a piston and cylinder assembly, a handrail hub engagement assembly on said rail deployment cables and resilient hand rail retaining element and means for positioning the prefabricated construction of the invention in the ground.

7. The underground service bay set forth in claim 6 further comprises, multiple support elements extending between one of said return flanges and said floor.

8. The underground service bay set forth in claim 6 wherein said movable access stairway comprises, multiple stair treads on wheeled assemblies, a collapsible handrail pivotally secured to said stairway, said stair treads are divided into treads portions of correspondingly alternating unequal tread depths.

9. The underground service bay set forth in claim 6 wherein said cover panels support arms have longitudinally offset portions secured to said panels.

10. The underground service bay set forth in claim 6 wherein piston and cylinder assemblies are secured to some of said pivoted panel support arms in spaced longitudinal relation to one another.

* * * * *